United States Patent [19]

Neidorf

[11] 4,033,483

[45] July 5, 1977

[54] REMOTE LIQUOR DISPENSING SYSTEM

[76] Inventor: Samuel W. Neidorf, 4615 Rubio Drive, Encino, Calif. 91316

[22] Filed: Nov. 28, 1975

[21] Appl. No.: 636,305

[52] U.S. Cl. ..... 222/145; 222/185; 222/325; 137/266; 137/453; 285/158; 285/371

[51] Int. Cl.[2] ..... B67D 5/60

[58] Field of Search ..... 222/129.1, 129.3, 129.4, 222/132, 136, 144.5, 145, 325, 185, 188; 137/453, 266; 285/158, 398, 371

[56] References Cited

UNITED STATES PATENTS

| | | | |
|---|---|---|---|
| 3,896,972 | 7/1975 | Neidorf | 222/145 X |
| 3,927,804 | 12/1975 | DeMann | 222/136 |
| 3,930,598 | 1/1976 | Slagle | 222/145 X |

FOREIGN PATENTS OR APPLICATIONS

| | | | |
|---|---|---|---|
| 1,937,176 | 2/1971 | Germany | 285/371 |

*Primary Examiner*—Stanley H. Tollberg
*Assistant Examiner*—Charles A. Marmor
*Attorney, Agent, or Firm*—Flam & Flam

[57] ABSTRACT

A gravity feeder for a liquor distribution system includes a manifold having a vented chamber, there being a series of vertically extending nipples on the manifold that are of different lengths. Interchangeable feeder caps detachably secured to individual bottles telescope over the manifold nipples to support the bottle in inverted position. Each feeder cap has a feeder tube that projects into the manifold chamber with its lower end at a level corresponding to the different lengths of the nipples themselves. A feeder system is established in which the bottles go on line in sequence. An uncomplicated and efficient system is provided.

3 Claims, 4 Drawing Figures

REMOTE LIQUOR DISPENSING SYSTEM

FIELD OF INVENTION

This invention relates to liquid feeders and mre particularly to liquid feeds for dispensing liquors such as at a commerical bar. More particularly this invention relates to remote liquid distribution systems of the type shown and described in Pat. No. 3,896,972, issued July 22, 1972 to Samuel W. Neidorf and Howard K. Aronld.

DISCUSSION OF THE PRIOR ART

Liquid dispensing systems utilizing remotely stored liquor are not only popular but also a near necessity in the operation of a high volume commercial bar. It is essential that the bartender fill orders as rapidly as possible and that he not be concerned with the problem of opening bottles and of rearranging spaces therefore during peak load. Even the task of inserting and removing pouring spouts is time consuming and tedious. The simplest method for dispensing liquor would be to utilize a large vat prefilled to an anticipated level before the bar opens. The problem is that the liquor control laws or regulations preclude such an arrangement. Accordingly it is necessary that individual fifths, quarts or half-gallons be somehow backed together or manifolded so that an adequate advance capacity is provided. The liquor control laws furthermore require that no bottle containing an alcoholic beverage be refilled. This has been construed to require an arrangement wherein there is no cross flow between banked or manifolded bottles. Additionally, the liquor control laws require that the strip stamp or remaining sections after bottle opening be visible at all times.

Various systems have been proposed and devised. Some systems utilize pressure feed. In general such systems are complicated, hazardous and otherwise not satisfactory. The best system is one in which feeds by gravity, is entirely uncomplicated and is effective, efficient and sanitary in fluid handling and that complies with liquor control laws regulations.

While the system shown in prior U.S. Pat. No. 3,896,972 is satisfactory it requires individual adjustment of the feeder tubes and stop collars. Some users have found it tedious to manipulate the individual stop collars thereby to determine the proper suquencing of the bottles. One of the objects of the present invention is to provide a system which requires only the removal of the bottle cap installation of a feeder cap, upending, and simple attachment of a bottle to a supporting manifold. Another object of this invention is to provide such a system in which an effective sealing arrangement is provided among the manifolded or banked bottles such that an imperfect seal at any one will not result in any flooding or loss of valuable liquor.

SUMMARY OF INVENTION

In order to accomplish the foregoing object, I provide an improved manifold structure that provides an simple telescopic support for upended bottles. A filler cap replaces the bottle cap and provides the simple telescopic arrangement as well as a multiple seal arrangement. The manifold determines the appropriate sequencing of the bottles so that the bottles empty in succession without any conscious effort on the part of the user. A simple system of graduated nipple heights in corrperation with novel filler caps ensures these results.

BRIEF DESCTIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims. Structural and operational characteristics attributed to forms of the invention first described shall also be attributed to forms later described, unless such characteristics are obviously in applicable or unless specific exception is made.

Figure 1:
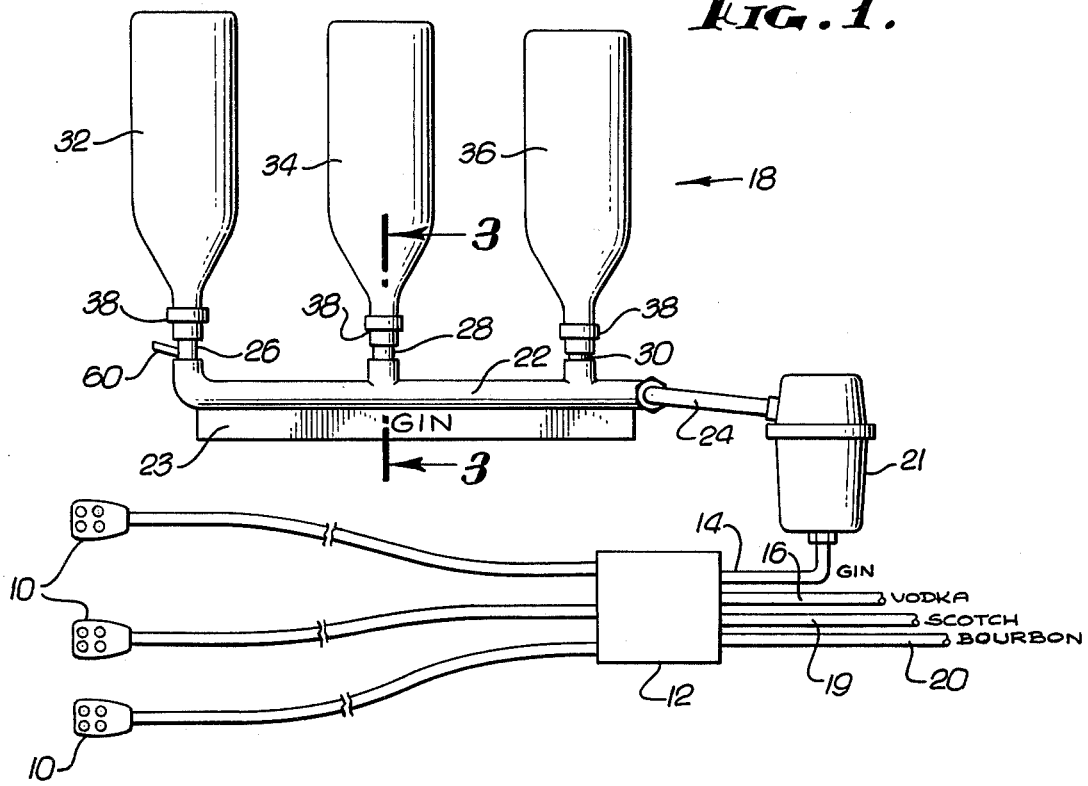
FIG. 1 is a diagrammatic view of the liquor dispensing system.

In FIG. 1 several hand-held dispensing heads 10 are shown that are located at various bar stations. Each dispensing head 10 has a series of buttons each of which causes opening of a corresponding fluid supply line for dispensing a bar liquor. A group of dispensing heads 10 are all served by a common distributor 12. There may be several distributors in the system. Supply lines 14, 16, 19 and 20 for GIN, VODKA, SCOTCH, BURBON, etc. service the distributors. At a suitable remote place, the supply lines are fed the particular liquor under pressure. The remote store 18 for GIN is illustrated by wauy of example.

Figure 2:
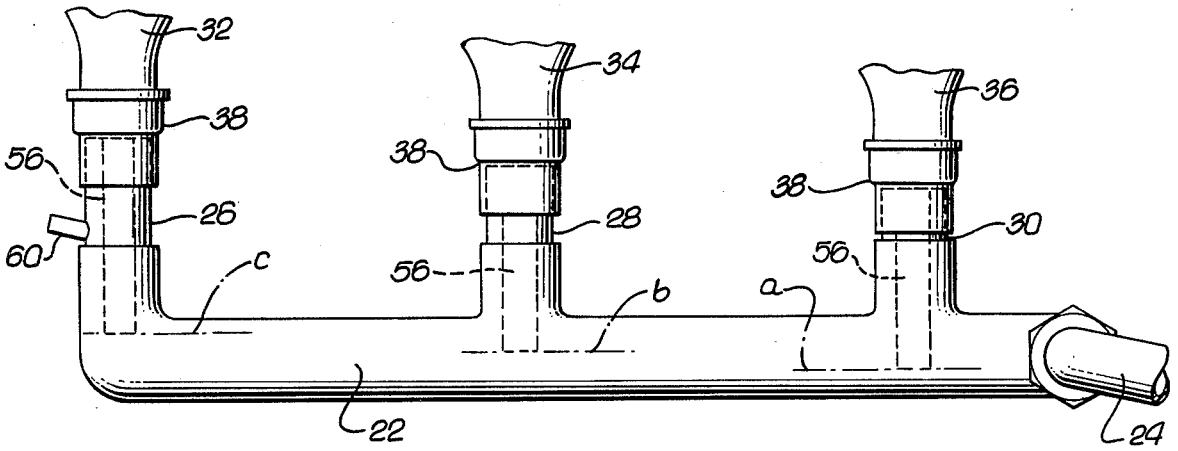
FIG. 2 is an enlarged elevational view of a three-bottle manifold forming a part of the FIG. 1 system.
Figure 3:
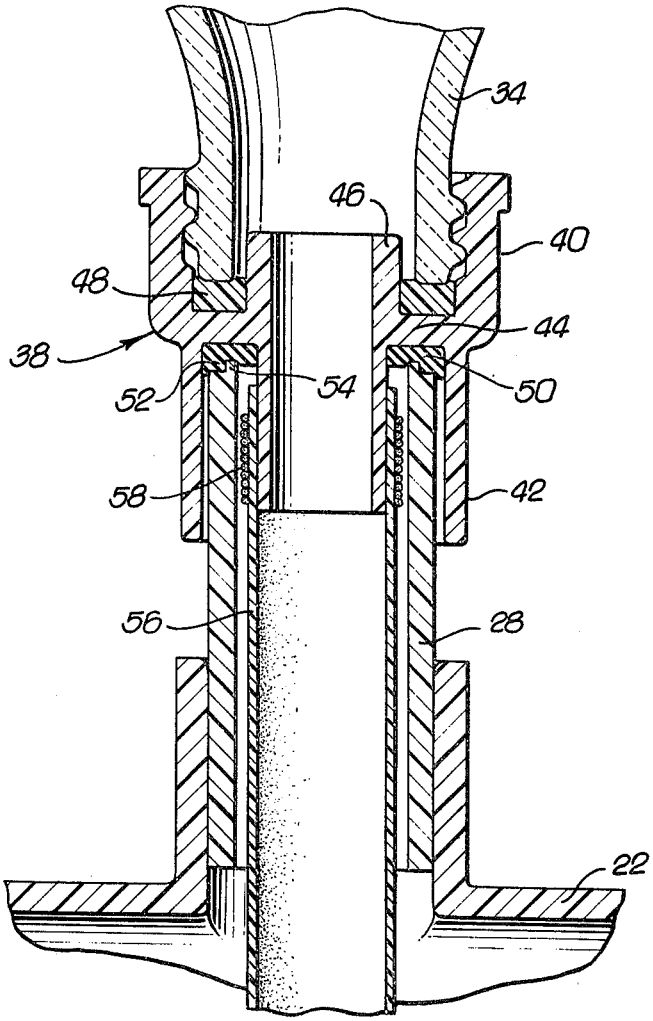
FIG. 3 is an enlarged fragmentary sectional view taken along a plane corresponding to line 3—3 of FIG. 1.

The bottled GIN liquor supply 18 includes a plastic manifold 22 designed to be horizontally supported in a manner diagrammatically illustrated by support 23. The manifold 22 has a discharge conduit 24 that gravity feeds a fluidic amplifier 21. The fluidic amplifier 21 may be of the type shown and described in U.S. Pat. No 3,788,343, issued Jan. 29, 1974 to Samuel W. Neidorf and Howard K. Arnold and entitled LIQUID DISPENSING APPARATUS. The manifold has a number (three in this instance) of upwardly projecting nipples 26, 28 and 30 (see also FIG. 2). The nipples detachably register with upended liquor bottles 32, 34 and 36. In order to establish the registry a detachable filler cap 38 (FIG. 3) is provided for each of the bottles 32, 34 and 36.

The filler cap 38 is generally tubular and made of molded plastic. One end 40 of the cap 38 has internal screw threads cooperating with the bottle. The other end 42 of the cap provides a cylindrical register. The ends are separated by a central partition 44. A conduit 46 is supported at the center of the partition 44 and extends on opposite sides. A compressible plastic sealing ring or washer 48 is fitted in the bottom of the annular space formed between the conduit 46 and the bottle end 40 for sealing engagement with the bottle.

The cylindrical register 42 is designed to telescope over any one of the nipples 26, 28 or 30 of the manifold 22 so that the upended bottle is firmly supported in a stable manner. A seal is effected between the nipple and the filler cap 38 by the aid of a second seal washer 50 that is located in the bottom of the annular space between the conduit 46 and the cylindricl register 42. The sealing ring has a peripheral rim 52 that closely surrounds and generally interfits a seat formed by a bead 54 at the very upper end of the nipple 28. The weight of the bottle (be it empty or full) is sufficient adquately to seat the bead 54 so that an effective seal is established notwithstanding slight back pressure that might occur due to some accidental cause. A chicken feeder type communication is established between each bottle and the interior of the manifold 22. For this purpose a flexible plastic tube 56 is attached to the discharge part of the conduit 46. It is secured by a spring clamp 58. The tubes 56 for all of the bottles are of nominally the same length. But the nipples 26, 28 and 30 are of graduated height to determine sequential discharge of bottle contents.

At the beginning of a day's run, all of the bottles 32, 34, 36 (FIG. 2) are more or less full. The liquid level is at *c* corresponding to the height of the lower end of the highest tube 56. Gravity feed is stopped at that point by the vacuum in the inverted bottle. When the fluid is drawn off, the vacuum is broken and the level is restored. Vent 60 ensures free air flow to the horizontal part of the manifold. The vent 60 is located in the higest nipple for reasons to be explained hereafter. When the first bottle is empty, the level approaches *b* and the next bottle 34 comes on line. Similarly, the last bottle 36 comes on line and the level is at *a* . To prepare for the next day's run, the empty bottles are removed and their screw caps installed on full bottles. One by one full bottles are positioned. The flexible tube 56 of each bottle is pinched closed and inserted into the corresponding nipple. The tube is released as the filler cap register 42 is carefully positioned. The liquid level rises in accordance with the position of the tube 56. The cycle repeats.

In the event that any one bottle is inadequately sealed at its washer 48, spillage may take place. However spillage will be localized because any rise in fluid level into companion nipples will be resisted by increased back pressure of air trapped. The seals 50 for all but the one where the vent 60 is located ensure that the air is in fact trapped. Any rise in the level of fluid in the end nipple where the vent 60 is located will necessarily isolate the vent from the leaking bottle whereupon spillage will terminate in the leaking bottle. If the leaking bottle is the one where the vent is located, the vent to that bottle will close off when the level reaches the end of the tube 56 whereupon spillage will likewise terminate by virtue of the vacuum drawn.

The bottles successively empty once the supply is renewed. There is no cross flow between bottles. The filler cap 38 at all times exposes the ends of the revenue strip stamp along the bottles neck. No unobvious or calculated steps are required on the part of the bartender or user. All that is necessary is to install and remove filler caps 38 and position the full bottles in any desired sequence. The external telescopic relationship of the register 42 as well as the seal 50 effectively prevent dust or dirt from entering the system. The vent 60 may be provided with a dust cap (not shown)

Figure 4:
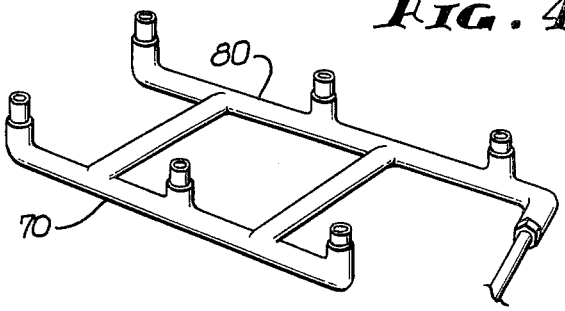
FIG. 4 is a pictorial view of a modified manifold structure for accommodating an increased number of bottles.

The manifold 22 can have any required capacity either by extending the length of the manifold or be a paralleling and interconnecting manifolds. The latter arrangement is illustrated in FIG. 4 in which two manifolds 70 and 80 are provided that are no slightly different levels. The slight change in levels in combination with the graduated length of nipples provides a definite sequence of on-line bottles.

Interding to claim all novel, useful and unobvious features shown or described, I make the following claims:

1. In a gravity feeder for a liquor distribution system:

a. a manifold having a vented chamber;

b. means forming an outlet from the chamber adapted to connect with a liquor supply line;

c. a plurality of upwardly opening nipples for individual cooperation with upended liquor bottles, the openings of said nipples being at various levels, said nipples communicating with said manifold chamber;

d. a plurality of feeder caps each cooperable with a liquor bottle and with a nipple for establishing communication therebetween, each feeder cap having one end detachably engageable with the neck of its companion bottle and having its other end provided with a register telescopicaly surrounding the corresponding nipple, each feeder cap having an abutment engaging the nipple to limit telescopic movement and to transmit the weight of the bottle of the nipple;

e. a flexible feeder tube for each cap and projecting into the manifold through the corresponding nipple for establishing communication between the corresponding bottle and said manifold chamber;

f. the feeder tubes of the companion feeder caps being of the same nominal length whereby the lower ends of said feeder tubes terminate at various levels in the manifold chamber corresponding to said levels of said nipple openings whereby the bottles come on line in sequence determined by the nipple opening level.

2. The gravity feeder as set forth in claim 1 in which each abutment is formed by an intermediate partition from which said feeder tube extends, there being a sealing ring at the bottom of the space between said register and said tube at said abutment, said sealing ring being engaged by the upper end of said nipple and urged by the weight of the corresponding upended bottle to establish a seal to trap air in said feeder cap to inhibit reverse flow of liquid.

3. The gravity feeder as set forth in claim 2 in which said chamber is vented by an opening formed in one of the nipples that is above the level of the lower end of the corresponding feeder tube.

* * * * *